US009761207B2

(12) United States Patent
Tadano

(10) Patent No.: US 9,761,207 B2
(45) Date of Patent: Sep. 12, 2017

(54) MUSICAL INSTRUMENT CARRIER

(71) Applicant: Yamaha Corporation, Hamamatsu-shi, Shizuoka-ken (JP)

(72) Inventor: Yuichi Tadano, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/266,038

(22) Filed: Sep. 15, 2016

(65) Prior Publication Data

US 2017/0092243 A1 Mar. 30, 2017

(30) Foreign Application Priority Data

Sep. 25, 2015 (JP) ..... 2015-188369

(51) Int. Cl.
*G10D 13/02* (2006.01)
*A45F 3/10* (2006.01)

(52) U.S. Cl.
CPC ..... *G10D 13/026* (2013.01); *A45F 3/10* (2013.01)

(58) Field of Classification Search
CPC ..... G10D 13/026; A45F 3/10
USPC ..... 84/421
See application file for complete search history.

(56) References Cited

U.S. PATENT DOCUMENTS 4,387,839 A * 6/1983 Dranchak ..... G10G 5/005 224/265
4,450,993 A * 5/1984 Ephraim ..... G10G 5/005 224/265
4,605,144 A * 8/1986 LaFlame ..... G10G 5/005 224/265
4,634,032 A * 1/1987 LaFlame ..... G10G 5/005 224/265
5,573,158 A * 11/1996 Penn ..... G10G 5/00 224/197
5,691,492 A * 11/1997 May ..... G10G 5/005 84/421
2004/0194608 A1* 10/2004 May ..... G10G 5/005 84/421
2005/0183565 A1* 8/2005 May ..... G10G 5/005 84/421
2009/0045235 A1* 2/2009 May ..... G10G 5/005 224/246

(Continued)

FOREIGN PATENT DOCUMENTS

JP 2003-5745 A 1/2003
JP 2003005745 A * 1/2003

*Primary Examiner* — David Warren
*Assistant Examiner* — Christina Schreiber
(74) *Attorney, Agent, or Firm* — Crowell & Moring LLP

(57) ABSTRACT

A musical instrument carrier includes a shoulder rest member that is abutted on the shoulders of a performer and an abdomen rest member that is provided separately from the shoulder rest member, that includes a portion coupled to the shoulder rest member, and that is abutted on the abdomen of the performer, in which coupling between the shoulder rest member and the abdomen rest member is achieved by plate-like members having a curved portion or a bent portion being overlapped and affixed in a state of making surface contact, and by changing the position at which the curved portions or bent portions overlap, it is possible to change the angle of the abdomen rest member with respect to the shoulder rest member.

7 Claims, 11 Drawing Sheets

(56) References Cited

U.S. PATENT DOCUMENTS

| | | | | |
|---|---|---|---|---|
| 2009/0165630 | A1* | 7/2009 | Hallerberg | G10G 5/005 84/421 |
| 2011/0030530 | A1* | 2/2011 | Schafer | G10G 5/005 84/421 |
| 2012/0255422 | A1* | 10/2012 | May | G10G 5/005 84/421 |
| 2016/0093276 | A1* | 3/2016 | Kasha | G10D 13/00 84/421 |
| 2016/0217775 | A1* | 7/2016 | May | G10D 13/026 |
| 2016/0225355 | A1* | 8/2016 | Shigenaga | G10G 5/005 |

* cited by examiner

MUSICAL INSTRUMENT CARRIER

BACKGROUND OF THE INVENTION

Field of the Invention

The present invention relates to a musical instrument carrier that supports a musical instrument at the front of a performer.

Priority is claimed on Japanese Patent Application No. 2015-188369, filed Sep. 25, 2015, the content of which is incorporated herein by reference.

Description of Related Art

A musical instrument carrier that supports a musical instrument such as a marching drum in front of a performer is conventionally used in parades, shows and the like.

While performing in a parade, show and the like, the performer sometimes comes to a halt and not only plays the instrument but also performs while moving. For this reason, it is desirable to enlarge the surface contact area between the body of the performer and the musical instrument carrier so that the load of the musical instrument and the musical instrument carrier does not become concentrated on a particular location of the body of the performer.

As a musical instrument carrier that has a shoulder rest member that is abutted on the shoulder of the performer and that is capable of lessening the load on the body of the performer, a marching carrier is disclosed for example in Japanese Unexamined Patent Application No. 2003-5745 (JP-A 2003-5745).

The marching carrier disclosed in JP-A 2003-5745 has a pair of support rods, one end of each being affixed to an abdominal abutting member, and the other end being positioned on the shoulder side of the performer being bent to the outer side in an L shape, a fastening rod holder that houses the other end of each support rode and that is clamped by a screw to each support rod, and a shoulder strap (shoulder rest member) that is affixed to each fastening rod holder and that is capable of rotating together with the fastening rod holder in the outer circumferential direction of the support rod.

Since the shoulder strap of the marching carrier constituted in the above manner is constituted to be rotatable with the end of the support rod serving as the axis of rotation, it is possible to increase the contact area between the performer and the shoulder rest member in accordance with the physique of the performer.

In the marching carrier disclosed in JP-A 2003-5745, the fastening rod holder that houses the end of the support rod is disposed in front of the shoulder strap. Also, the screw for clamping the fastening rod holder to the support rod is disposed on the side at which the musical instrument is supported. For this reason, a bulge due to the fastening rod holder (a bulge formed by the fastening rod holder and the screw) ends up being formed in front of the chest of the performer.

When this kind of bulge is present, when the performer wears the musical instrument carrier under a costume, the costume catches on the bulge, or rubs locally while moving, leading to the risk of damage to the costume. In addition, when the aforementioned bulge is present, there is an adverse effect on the appearance in the case of the musical instrument carrier being worn over the costume.

Also, in the marching carrier disclosed in JP-A 2003-5745, since the fastening rod holder is affixed by clamping the periphery of the support rod with the rod holder, the area that is held is small. For this reason, the holding force in the rotation direction having the support rod as the axis of rotation is weak, giving rise to the problem of the marching carrier easily shifting from the body of the performer during a performance. In particular, when the musical instrument is heavy, the shifting problem is prominent.

SUMMARY OF THE INVENTION

The present n ion was achieved in view of the aforementioned circumstances, and has as its object to provide a musical instrument carrier that is capable of suppressing damage to a costume and that can inhibit shifting from the body of the performer during a performance.

The musical instrument carrier of the present invention is a musical instrument carrier that supports a musical instrument in front of a performer, including: a shoulder rest member that is abutted on the shoulders of the performer; an abdomen rest member that is provided separately from the shoulder rest member, that includes a coupling structure that is directly or indirectly coupled to the shoulder rest member, and that is abutted on the abdomen of the performer; and a plurality of plate-like members that each have a curved portion or a bent portion, in which the coupling structure is formed by overlapping and affixing the plate-like members in astute of making surface contact.

In this musical instrument carrier, it is preferred that the angle of the abdomen rest member with respect to the shoulder rest member be changed by mutually changing the position at which the curved portions or the bent portions in the plate-like members overlap.

According to the musical instrument carrier of one aspect of the present invention, it is possible to couple the coupling member and the shoulder abutting member with a smaller bulge than the bulge that is formed by fastening a fastening rod holder to a conventional support rod with a screw.

Thereby, it is possible to improve the appearance of the musical instrument carrier, and it is possible to inhibit damage to a costume in the case of a performer wearing the musical instrument carrier under a costume.

Also, it is possible to inhibit shifting of the musical instrument carrier from the body of a performer during a performance.

In the musical instrument carrier described above, the plate-like members may include a coupling member that is included in the abdomen rest member and a slide member that is included in the shoulder rest member; the coupling member may be located at the shoulder rest member side of the abdomen rest member and arranged on at least one surface of the shoulder rest member; and the curved portion or the bent portion may be provided in the coupling member, with the shoulder rest member and the abdomen rest member being coupled by the surface of the curved portion or the bent portion provided in the coupling member and the surface of the curved portion or the bent portion provided in the shoulder rest member being fastened with a fastening means in an overlapped state.

Also, in the musical instrument carrier described above, the slide member may be located at the abdomen rest member side of the shoulder rest member and arranged on at least one surface of the abdomen rest member and the curved portion or the bent portion may be provided in the slide member, with the shoulder rest member and the abdomen rest member being coupled by the surface of the curved portion or the bent portion provided in the slide member and the surface of the curved portion or the bent portion provided in the abdomen rest member being fastened with a fastening means in an overlapped state.

By adopting such a constitution, it is possible to easily change the angle of the abdomen rest member with respect to the shoulder rest member and possible to reliably maintain the angle.

Also, in the musical instrument carrier described above, the shoulder rest member may be constituted to be slidable with respect to the coupling member in a circular arc shape or in multiple stages, or detachable at different positions in multiple stages.

In this manner, by having a shoulder rest member that is slidable in a circular arc shape or in multiple stages or detachable at different positions in multiple stages so as to be coupled to the coupling member at different angles, it is possible to adjust the position of the musical instrument with respect to the shoulder rest member by changing the angle or top point position of the shoulder rest member.

Thereby, since it becomes possible to increase the contact surface area between the musical instrument carrier and the performer by having the shape of the shoulder rest member conform to the physique of the performer, it is possible to inhibit shifting of the musical instrument carrier from the body of the performer during a performance.

Also, in the musical instrument carrier described above, the plate-like members may include two plates that are oppositely arranged with a predetermined spacing; one portion of the shoulder rest member may be arranged between the two plates; and both surfaces of the one portion of the shoulder rest member respectively may make surface contact with the opposing surfaces of the two plates.

In this way, by causing the two surfaces of the one portion of the shoulder rest member to make surface contact respectively with the one surface of the two plate-like members, it is possible to further increase the resistance generated when the shoulder rest member shifts. Thereby, it is possible to further inhibit shifting of the musical instrument carrier from the body of the performer during a performance.

In the musical instrument carrier described above, the plate-like members may include two plates that are oppositely arranged with a predetermined spacing; the one portion of the abdomen rest member may be arranged between the two plates; and both surfaces of the one portion of the abdomen rest member may respectively make surface contact with the opposing surfaces of the two plates.

By adopting such a constitution, by causing the two surfaces of the one portion of the abdomen rest member to make surface contact respectively with the one surface of the two plate-like members, it is possible to further increase the resistance generated when the abdomen rest member shifts. Thereby, it is possible to inhibit shifting of the musical instrument carrier from the body of the performer during a performance.

The present invention leads to an improvement in appearance, can inhibit damage to a costume, and can inhibit shifting of the musical instrument carrier from the performer during a performance.

DETAILED DESCRIPTION OF THE INVENTION

Figure 1:
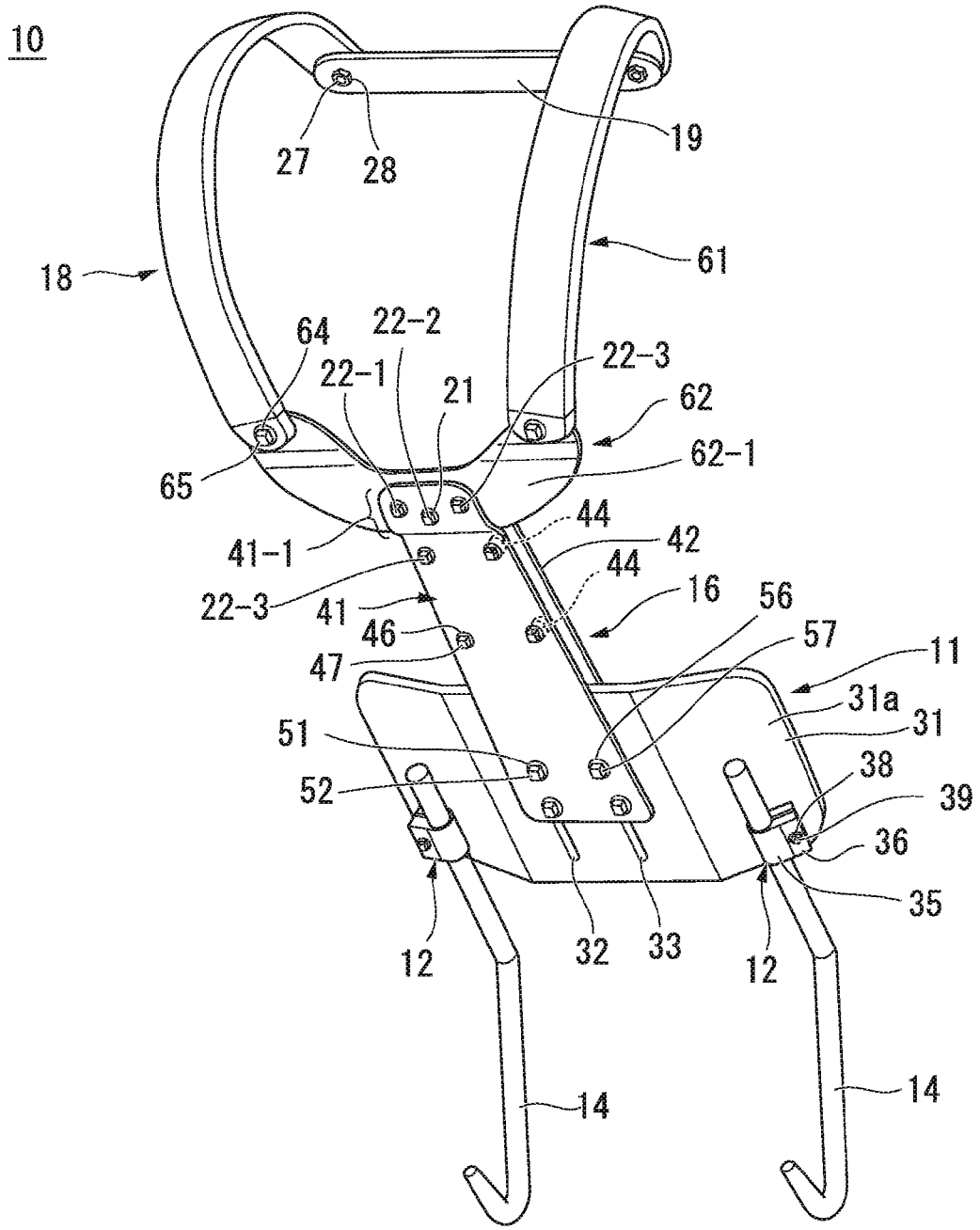
FIG. 1 is a perspective view showing the musical instrument carrier according to one embodiment of the present invention.

Hereinbelow, an embodiment applying the present invention will be described in detail referring to the drawings. Note that the drawings used in the following description are for describing the constitution of the embodiment of the present invention, and the size, thickness, and dimensions of each part that is illustrated may differ from the dimensional relation of the actual musical instrument carrier.

Note that in the following embodiment, directions such as up and down, unless otherwise specified, indicate directions in reference to a state of the performer standing while wearing the musical instrument carrier.

Embodiment

Figure 2:
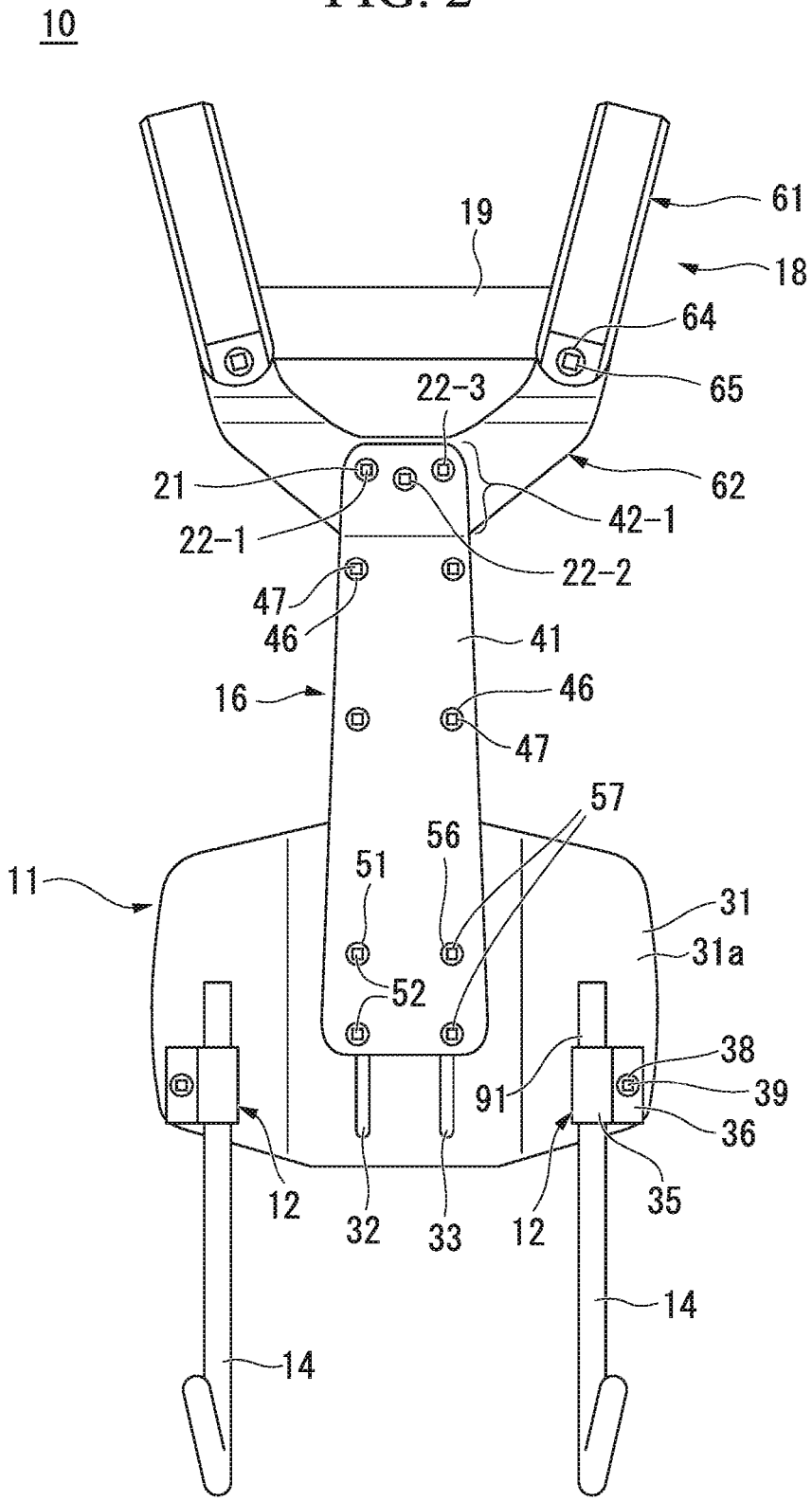
FIG. 2 is a front view showing the musical instrument carrier of the present embodiment.
Figure 3:
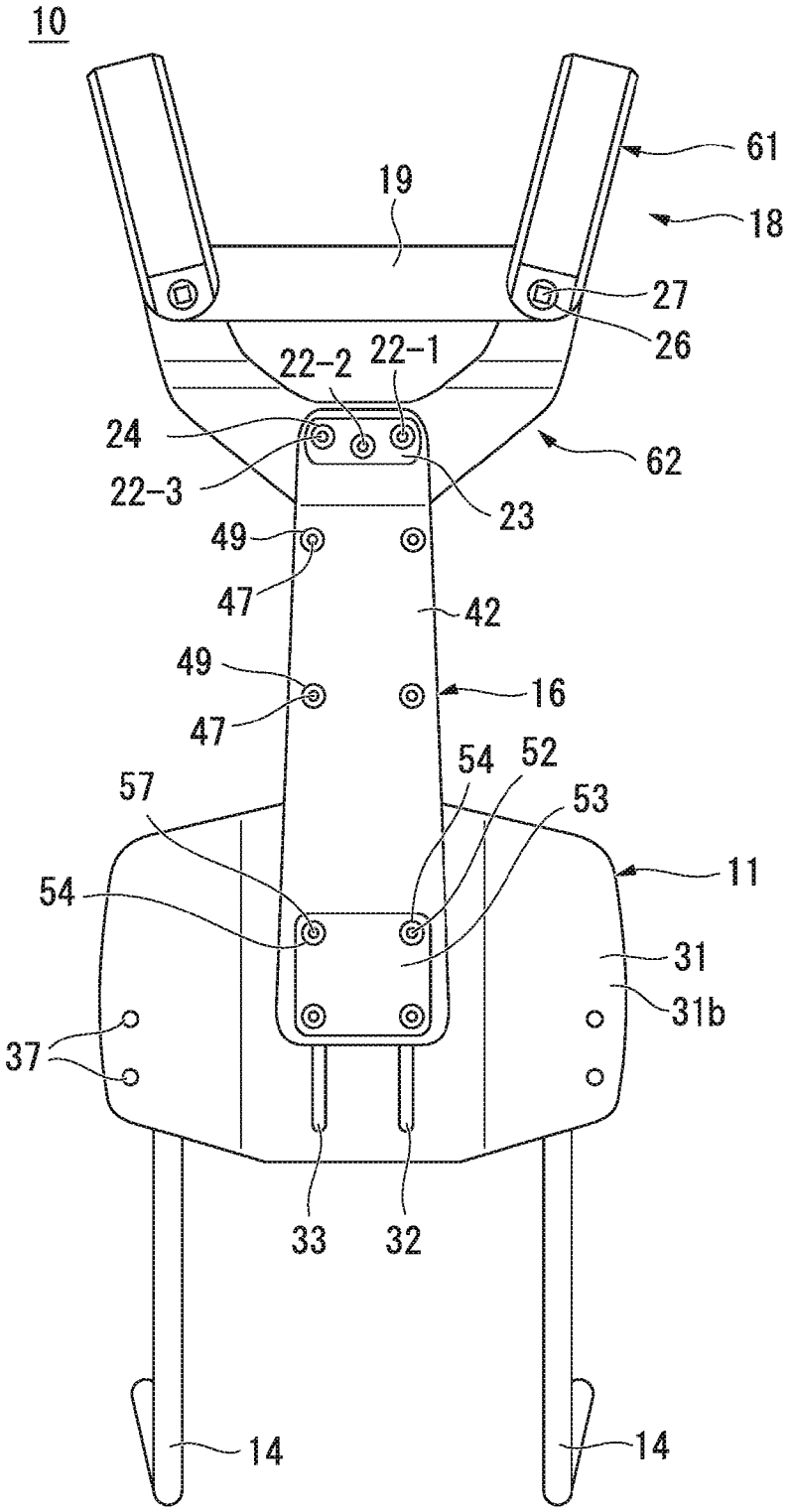
FIG. 3 is a back view showing the musical instrument carrier of the present embodiment.
Figure 4:
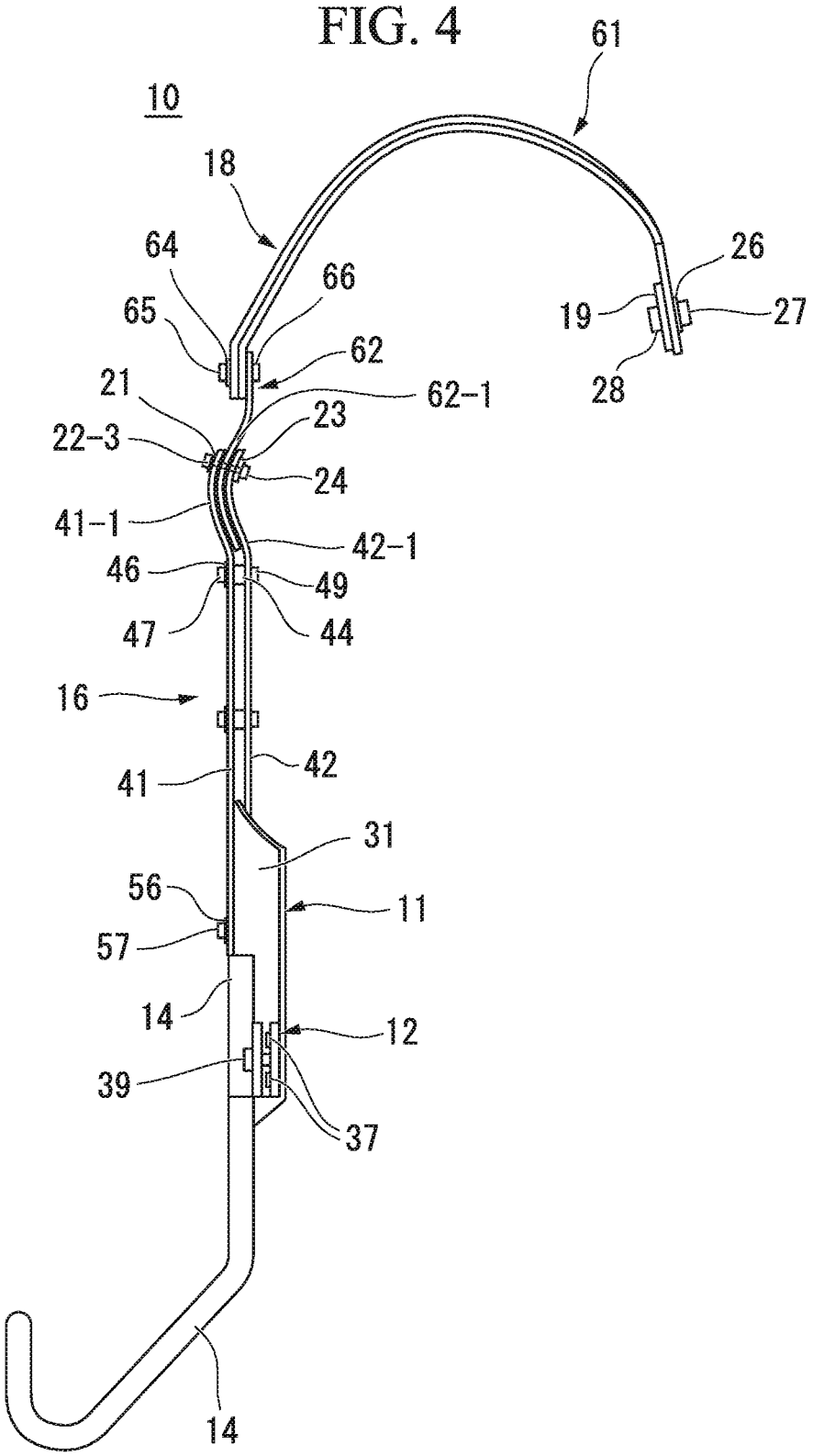
FIG. 4 is a side view showing the musical instrument carrier of the present embodiment.

FIG. 1 is a perspective view of the musical instrument carrier according to the embodiment of the present invention. FIG. 2 is a front view of the musical instrument carrier shown in FIG. 1. FIG. 3 is a back view of the musical instrument carrier shown in FIG. 1. FIG. 4 is a side view of the musical instrument carrier shown in FIG. 2. In FIG. 2 to FIG. 4, the same reference numerals are given to those constituent portions that are the same as the corresponding portions of the musical instrument carrier 10 shown in FIG. 1.

Referring to FIG. 1 to FIG. 4, the musical instrument carrier 10 of the present embodiment has an abdomen rest member 11, a pair of rod clamps 12, a pair of rods 14, a coupling member 16, a shoulder rest member 18, and a back rest member 19. These members are assembled by a plurality of washer plates 21 and 26, bolts 22-1, 22-2, and 22-3, a backing plate 23, a plurality of nut plates 24 and 28, and a plurality of bolts 27 and the like.

The abdomen rest member 11 has an abdomen rest member main body 31 and slide grooves 32 and 33. The abdomen rest member main body 31 is a plate-like member that is formed with the side portions thereof curved so as to match the shape of the abdomen of the performer. A back surface 31*b* of the abdomen rest member main body 31 is abutted on the abdomen of the performer.

The abdomen rest member 11 is preferably constituted by a lightweight material (for example, aluminum) from the standpoint of easing the burden on the performer.

The slide grooves 32 and 33 are provided in parallel at the center portion of the abdomen rest member main body 31, and pass through the abdomen rest member main body 31.

The slide grooves 32 and 33 are arranged on that they may extend in the extension direction of the coupling member 16

(in other words, the height direction (vertical direction) in the state of the performer wearing the musical instrument carrier 10).

The widths of the slide grooves 32 and 33 are respectively set to a size through which the respective shafts of bolts 52 and 57 can pass.

The pair of rod clamps 12 are arranged at the lower portion of the front surface 31*a* on both sides of the abdomen rest member main body 31.

The rod clamp 12 has a rod housing portion 35, a protruding portion 36, a washer plate 38, and a bolt 39.

The rod housing portion 35 has a rod insertion hole (penetration hole) in which the rod 14 can be inserted. The rod insertion hole is a hole that penetrates the rod housing portion 35.

The protruding portion 36 is constituted by two plate portions oppositely disposed with a gap interposed therebetween. Of the two plate portions, the plate portion in contact with the front surface 31*a* side of the abdomen rest member main body 31 is affixed to the abdomen rest member main body 31 with two screws 37 from the back surface 31*b* side of the abdomen rest member main body 31. The protruding portion 36 is integrally constituted with the rod housing portion 35.

A bolt 39 is fastened so as to reach the two plate portions constituting the protruding portion 36 via the washer plate 38. Loosening the bolt 39 widens the gap between the two plate portions, whereby since the rod insertion hole also widens, a state arises of the rod 14 being able to move in the extension direction of the rod insertion hole within the rod clamp 12.

On the other hand, tightening the bolt 39 narrows the gap between the two plate portions, whereby since the diameter of the rod insertion hole also narrows, the position of the rod 14 is restricted (in other words, the opening degree and height of the rod 14 are fixed).

Each rod 14 is constituted by bending back a portion of a rod-like member. One end side at the bent back tip of the rod 14 has a function of supporting a musical instrument. The bolt 39 is fastened in the state of the other end side of the rod 14 being housed in the rod insertion hole of the rod clamp 12, whereby the opening degree and height of the rods 14 are fixed.

For example, in the case of using the musical instrument carrier 10 to support a drum, one end side of the rods 14 are respectively inserted in the two rod insertion holes provided in the carrier coupling member (not illustrated) mounted on the drum. For this reason, in the case of supporting a drum using the musical instrument carrier 10, it is necessary to adjust the opening degree and position of the rods 14 so that the rods 14 can be inserted in the two rod insertion holes of the carrier coupling member mounted on the drum.

Note that in FIG. 1, as one example of the rod 14 a rod formed in a J shape is given as an example, but the shape of the rod 14 can be suitably selected in accordance with the musical instrument to be supported, and is not limited to the shape shown in FIG. 1.

Figure 5:
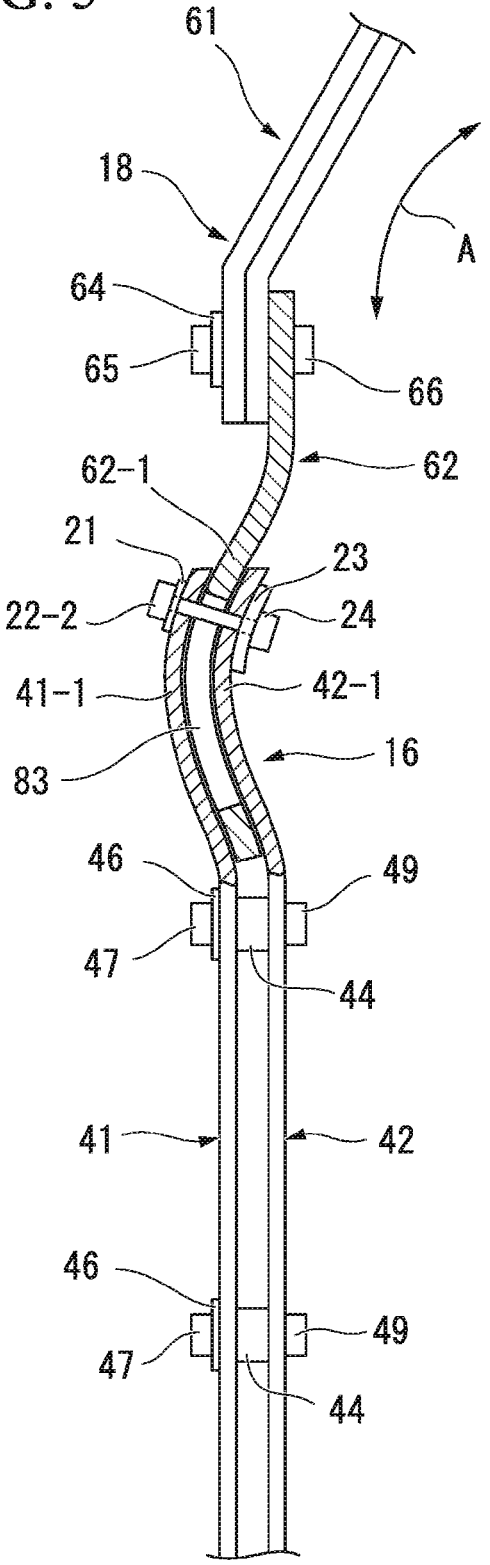
FIG. 5 is a partial magnified side view showing in detail the musical instrument carrier of the present embodiment.

FIG. 5 is a side view that is an enlargement of a portion of the musical instrument carrier shown in FIG. 4. In FIG. 5, the same reference numerals are given to those constituent portions that are the same as the corresponding portions of the musical instrument carrier 10 shown in FIG. 1 to FIG. 3.

Note that in FIG. 5, for the sake of convenience of description, a pair of first curved portions 41-1 and 42-1 and a second curved portion 62-1 are illustrated in cross section.

The coupling member 16 has a pair of plate members 41 and 42, a plurality of spacers 44, a plurality of washer plates 46, 51, and 56, a plurality of bolls 47, 52, and 57, a plurality of nut plates 49 and 54, and a rest plate 53.

The plate member 41 is a flat plate-shaped member that extends between the abdomen rest member 11 and the shoulder rest member 18, and is shaped such that the width thereof narrows as the distance increases from the abdomen rest member 11. The plate member 41 has a first curved portion 41-1 that constitutes the upper end portion positioned on the shoulder rest member 18 side.

The first curved portion 41-1 is formed by curving a portion on the upper end portion side of the plate member 41, resulting in a shape constituted by a portion cut from a hollow cylinder along the axial line thereof. The shape of the first curved portion 41-1, in the state of the performer wearing the musical instrument carrier 10, projects out in a direction heading away from the chest of the performer, with a concavity formed on the performer's side.

Holes (not illustrated) that a plurality of the bolts 52 and 57 penetrate are provided at the lower end portion side of the plate member 41 so that the positions of the holes agree with at least a portion of the slide grooves 32 and 33, and the plate member 41 is arranged to come into contact with the center part of the front surface 31*a* of the abdomen rest portion main body 31. The plate member 41 extends in the vertical direction, with a portion of the plate member 41 projecting upward of the abdomen rest member 11.

The plate member 42 is a member that is constitute similarly to the aforementioned plate member 41, and has a first curved portion 42-1 by curving a portion on the upper end portion side thereof. The plate member 42 is arranged on the back surface side of the abdomen rest member 11, opposing the plate member 41 so that the first curved portion 42-1 faces the first curved portion 41-1.

An example material of the plate members 41 and 42 includes aluminum, which is a lightweight metal.

A plurality of spacers 44 are arranged between the opposing surfaces of the plate members 41 and 42, which project out from the abdomen rest member 11. The plurality of spacers 44 each have a penetration hole allowing the insertion of a bolt 47. The shape of the plurality of spacers 44 can for example be made cylindrical.

The plurality of spacers 44 have a function of maintaining the spacing between the opposing surfaces of the plate members 41 and 42 at a predetermined spacing by the height thereof.

The length of the plurality of spacers 44 should be set so as to be a slightly greater value than, for example, the thickness of the abdomen rest member main body 31 and the thickness of the slide member 62 described below that constitutes the shoulder rest member 18.

Thereby, a gap that enables sliding of the abdomen rest member 11 arranged between the lower end portions of the plate members 41 and 42 and a gap that enables sliding of the second curved portion 62-1 of the slide member 62 arranged between the first curved portions 41-1 and 42-1 are respectively formed.

Each of the plurality of bolts 47 passes through the washer plate 46 and the spacer 44, and is screwed into a nut plate 49 arranged at the back surface of the plate member 42. Thereby, the plate members 41 and 42 are affixed.

Note that in the present embodiment, as one example, the case of using four each of the spacer 44, the washer plate 46, the bolt 47, and the nut plate 49 was given as an example, but the numbers of the spacers 44, the washer plates 46, the bolts 47, and the nut plates 49 can be suitably selected and are not limited to four.

The bolts 5 penetrate the rest plate 53 that is arranged on the back surface of the slide groove 32 and the plate member 42.

The bolts 57 penetrate the rest plate 53 that is arranged on the back surface of the slide groove 33 and the plate member 42. Each of the bolts 52 and 57 is screwed into the nut plate 54.

By passing the respective shaft portions of two bolts (two of the bolts 52 or two of the bolts 57) in each of the parallel slide grooves 32 and 33 at mutually differing positions, the coupling member 16 can be made to slide so as to follow the extension direction of the slide grooves 32 and 33 without the coupling member 16 tilting with respect to the extension direction of the slide grooves 32 and 33.

Thereby, it is possible to easily adjust the height of the abdomen rest member 11 so as to abut the abdomen of the performer wearing the musical instrument carrier 10.

The abdomen rest member main body 31 is disposed between the plate members 41 and 42, and by tightening the bolts 52 and 57, the position thereof is maintained. On the other hand, by loosening the bolts 52 and 57, the positional relation of the abdomen rest member main body 31 with the plate embers 41 and 42 is adjusted by mutually shifting the position thereof without the abdomen rest member main body 31 being separated from the plate members 41 and 42.

That is, by sliding the abdomen rest member main body 31 in the extension direction of the slide grooves 32 and 33 with respect to the plate members 41 and 42, it is possible to easily adjust the position of the abdomen rest member main body 31 with respect to the plate members 41 and 42.

The positional relations of the abdomen rest member main body 31 and the plate members 41 and 42 are maintained by sandwiching them so that the front surface 31*a* of the abdomen rest member main body 31 and the back surface of the plate member 41 make surface contact, and the back surface 31*b* of the abdomen rest member main body 31 and the front surface of the plate member 42 make surface contact. Accordingly, compared to the case of the abdomen rest member main body 31 being held by only one surface thereof making surface contact with a plate member, it is possible to increase the resistance between the abdomen rest member main body 31 and the plate members 41 and 42. Thereby, the musical instrument carrier is less susceptible to shifting from the body of the performer during a performance.

The shoulder rest member 18 has a pair of shoulder rest member main bodies 61, a slide member 62, a plurality of washer plates 64, a plurality of bolts 65, and a plurality of nuts 66.

The shoulder rest member main bodies 61 are for example formed by curving a plate material. The shoulder rest member main bodies 61 curve over a longer range than the first curved portions 41-1 and 42-1. From the standpoint of lightening the musical instrument carrier 10, it is possible to use for example aluminum as the material of the shoulder rest member main bodies 61.

Figure 6:
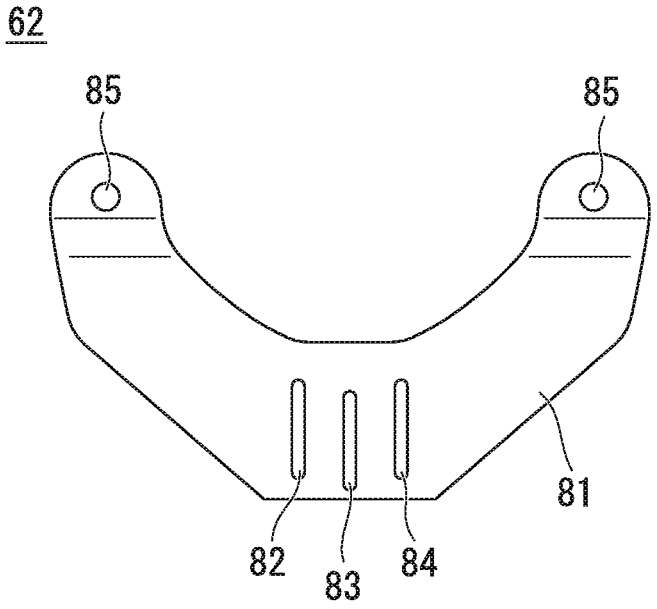
FIG. 6 is a front view showing the slide member shown in FIG. 2.

FIG. 6 is a front view of the slide member shown in FIG. 2. In FIG. 6, the same reference numerals are given to those constituent portions that are the same as the corresponding structures shown in FIG. 1 to FIG. 5.

The slide member 62 has a slide member main body 81 that is a plate-shaped member formed in a U shape, slide grooves 82 to 84, and bolt holes 85.

As shown in FIG. 5, as a portion of the shoulder rest member 18, at the lower portion of the slide member 62 a second curved portion 62-1 is formed having a shape corresponding to the curved shapes of the first curved portions 41-1 and 42-1.

The second curved portion 62-1 is the shape of a portion of a hollow cylinder that is severed along the axis line, with a convex shape toward the front surface side of the musical instrument carrier. The upper portion of the slide member 62 conversely is convex-shaped toward the back surface side of the musical instrument carrier. The curved portion 62-1 of the slide member 62 is capable of sliding in the vertical direction within the curved space formed between the pair of first curved portions 41-1 and 42-1. The front surface and back surface of the curved portion 62-1 of the slide member 62 are shaped to come in contact with the respective facing surfaces of the pair of first curved portions 41-1 and 42-1.

The second curved portion 62-1 is inserted in the gap formed between the pair of first curved portions 41-1 and 42-1. The second curved portion 62-1 slides while being guided along the circular arcs of the curved surfaces of the pair of first curved portions 41-1 and 42-1.

From the standpoint of weight reduction of the musical instrument carrier 10, it is possible to use, for example, aluminum as the material of the slide member main body 81.

The three slide grooves 82 to 84 are provided so as to pass through the center portion of the second curved portion 62-1. The slide grooves 82 to 84 are grooves that extend parallel to one another in the curved direction of the second curved portion 62-1.

The groove width of each of the slide grooves 82 to 84 is set to a size in which the shaft portion of each of the bolts 22-1 to 22-3 can pass, yet the head portion of each of the bolts 22-1 to 22-3 and the washer plates 21 cannot pass.

The bolt hole 85 is provided at both end portions of the slide member main body 81 that is formed in a U shape. Each bolt hole 85 is provided so as to penetrate the slide member main body 81. The bolt 65 is screwed into the bolt hole 85.

The bolt 65, via the washer plate 64, penetrates the portion at which one end portion of the shoulder rest member main body 61 and the front surface side of the bolt hole 85 of the slide member 62 overlap. The bolt 65 is screwed into the nut 66 that is disposed on the back surface side of the slide member 62. Thereby, both ends of the slide member 62 and the pair of shoulder rest member main bodies 61 are respectively coupled.

The shaft portion of the bolt 22-1 is inserted in the slide groove 82 and screwed into the nut plate 24 no as to sandwich the pair of first curved portions 41-1 and 42-1 and the backing plate 23 by the washer plate 21 and the nut plate 24. The diameter of the shaft portion of the bolt 22-1 is constituted so as to be narrower than the width of the slide groove 82.

The shaft portions of the bolts 22-2 and 22-3 are respectively inserted in the slide grooves 83 and 84 and screwed into the nut plates 24 similarly to the bolt 22-1.

In this way, by coupling the pair of first curved portions 41-1 and 42-1 and the second curved portion 62-1, which are constituted by curving a plate material, using the bolls 22-1, 22-2, and 22-3, the washer plate 21, and the nut plate 24, it is possible to couple the coupling member 16 and the shoulder rest member 18 with a smaller bulge than the bulge formed by fastening with a screw the fastening rod holder to the conventional support rod (refer to JP-A 2003-5745).

Thereby, it is possible to improve the appearance of the musical instrument carrier 10, and possible to suppress damage to a costume in the case of a performer wearing the musical instrument carrier 10 under a costume.

The slide grooves 82 to 84 are provided in the second curved portion 62-1 arranged between the pair of pair of first curved portions 41-1 and 42-1. The shaft portions of the bolts 22-1, 22-2, 22-3 are respectively disposed in these slide grooves 82 to 84 and screwed into one nut plate 24. With this structure, when the bolts 22-1, 2 and 22-3 have been loosened, it is possible to slide the second curved portion 62-1 in a circular arc in the extension direction of the slide grooves 82 to 84 (the A direction in FIG. 5) in accordance with the physique of the performer wearing the musical instrument carrier 10.

Thereby, it is possible to easily adjust the angle and top-point position of the shoulder rest member 18 along the circular arc of the large curvature of the curved portions, in conformance with the physique of the performer wearing the musical instrument carrier 10. After this adjustment, by tightening the bolts 22-1, 22-2, and 22-3, since it is possible to keep the curved surfaces with large curvatures of the curved portions in the state of contact, it is possible to inhibit shifting of the musical instrument carrier 10 from the body of the performer during a performance.

Adjustment of the angle and position of the shoulder rest member 18 with respect to the abdomen rest member 11 in this way is performed by sliding the engagement position of the second curved portion 62-1 of the slide member 62 with respect to the first curved portions 41-1 and 42-1 of the coupling member 16. The first curved portions 41-1 and 42-1 are formed by curving the coupling member 16. The second curved portion 62-1 is formed by curving the slide member 62. For this reason, the pair of first curved portions 41-1 and 42-1 and the second curved portion 62-1 can be formed with a larger curvature than the rod and rod holder coupling the abdomen rest member and shoulder rest member in a convention musical instrument carrier. That is, both curved surfaces having a convex part and a concave part of the second curved portion 62-1 and the respectively opposing surfaces of the pair of first curved portions 41-1 and 42-1 make surface contact with a large curvature in the manner of being sandwiched.

Thereby, it is possible to support the abdomen rest member 11 with respect to the shoulder rest member 18 by surface contact of a large curvature. That is, the surface area over which the slide member 62 and the coupling member 16 make contact increases, whereby the holding force becomes greater. Accordingly, since it becomes easier to maintain the state of the musical instrument carrier 10, in particular the abdomen rest member 11 thereof, being in close contact with the body of the performer, it is possible to inhibit shifting of the musical instrument carrier 10 from the body of the performer during a performance.

Also, since the pair of first curved portions 41-1 and 42-1 and the second curved portion 62-1 have a circular arc shape, by sliding the slide member 62 with respect to the coupling member 16 along the curvature direction in the shape of the arc, it is possible to continuously change the attachment angle of the abdomen rest member 11 with respect to the shoulder rest member 18.

Figure 7:
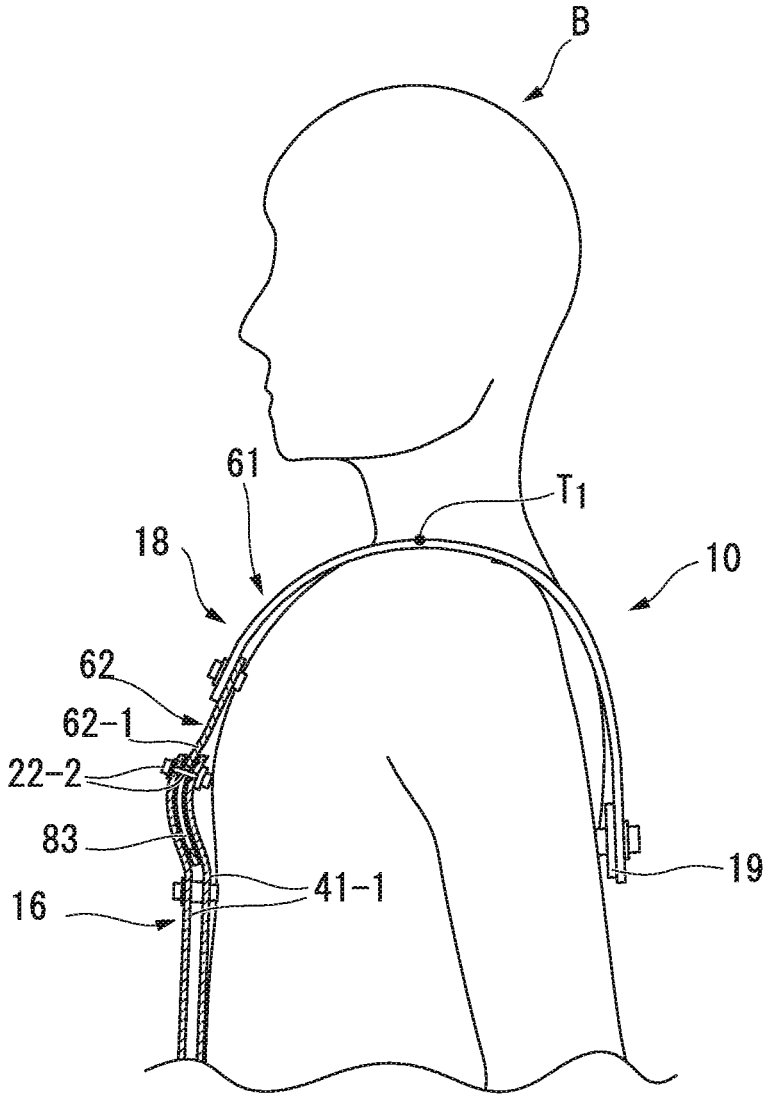
FIG. 7 is a side view showing the state of a performer with a thin physique wearing the musical instrument carrier of the present embodiment.
Figure 8:
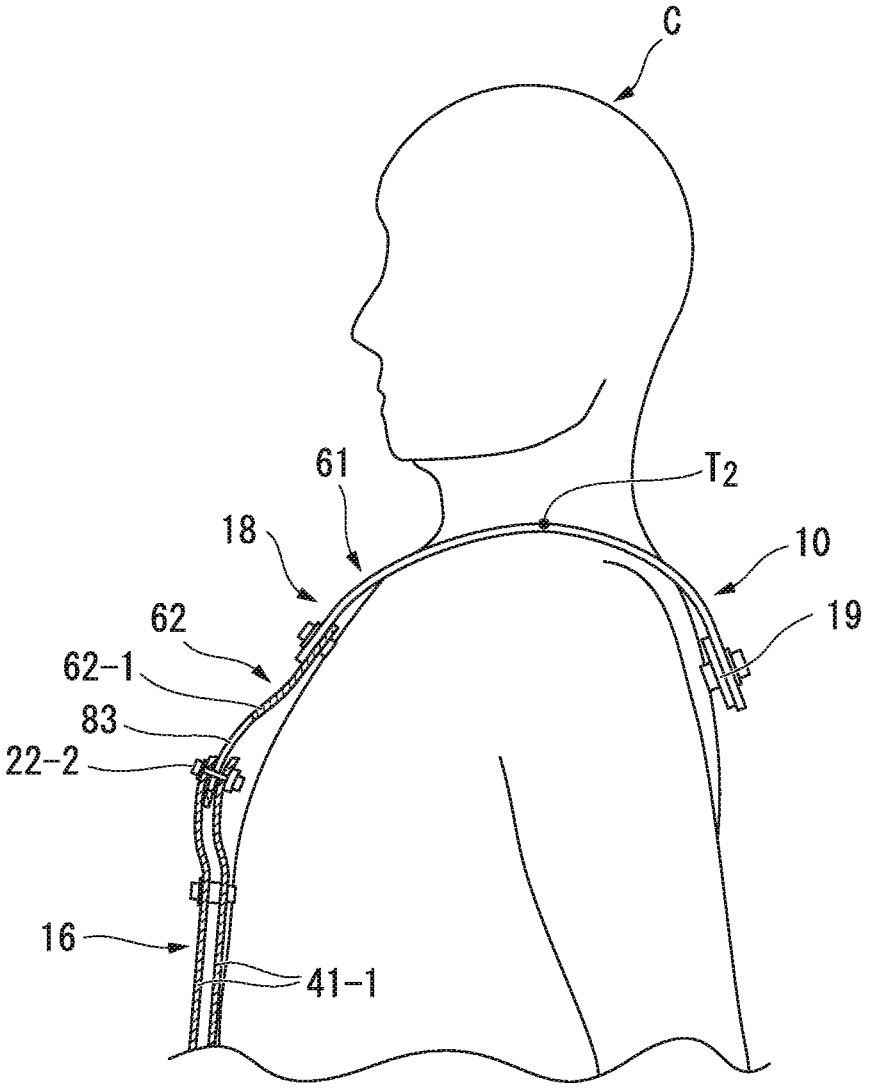
FIG. 8 is a side view showing the state of a performer with a heavy physique wearing the musical instrument carrier of the present embodiment.

FIG. 7 is a side view that schematically shows the state of a performer with a thin physique wearing the musical instrument carrier shown in FIG. 4. FIG. 8 is aside view that schematically shows the state of a performer with a heavy physique wearing the musical instrument carrier shown in FIG. 4.

In FIG. 7 and FIG. 8, the same reference numerals are given to those constituent portions that are the same as the corresponding structures shown in FIG. 1 to FIG. 6. Also, in FIG. 7 and FIG. 8, for the sake of convenience of description, the pair of first curved portions 41-1 and 42-1 and the second curved portion 62-1 are illustrated in cross section.

Here, the manner in which the second curved portion 62-1 slides between the curved portions 41-1 and 42-1 in accordance with the physique of the performer, and whether the musical instrument carrier is mounted on the performer will be described.

When a performer B with a thin physique (a physique with a small abdominal thickness) wears the musical instrument carrier 10, since the performer B's body is thin, the second curved portion 62-1 slides downward along the pair of first curved portions 41-1 and 42-1. Thereby, the top point $T_1$ of the shoulder rest member 18 is disposed at a position near the coupling member 16. At such a position, a state arises in which the contact surface area of the shoulders of the performer B and the shoulder rest member 18 is large.

When a performer C with a heavy physique (a physique with a large abdominal thickness) wears the musical instrument carrier 10, since the performer C's body is thick, the second curved portion 62-1 slides upward along the curved surfaces of the pair of first curved portions 41-1 and 42-1, and the top point $T_2$ of the shoulder rest member 18 is formed at a position far from the coupling member 16 (a position farther than the top point $T_1$ shown in FIG. 7).

At such a position, a state arises in which the contact surface area of the shoulders of the performer C and the shoulder rest member 18 is large.

As described above, by the sliding of the second curved portion 62-1 along the curved surfaces of the pair of first curved portions 41-1 and 42-1, it is possible to change the angle and top-point position of the shoulder rest member 18. Thereby, it is possible to increase the contact surface area between the shoulders of performers of various physiques and the shoulder rest member 18.

Note that although not illustrated, a cushion member that protects the abdominal portion, chest portion, or shoulders of the performer may as needed be provided on the back surface 31*b* of the abdomen rest member main body 31, the surface of the coupling member 16 (back surface of the plate member 42) that comes into contact with the chest of the performer, and the lower surface of the shoulder rest member 18 that comes into contact with the shoulders of the performer.

Thereby, even in the case of using the musical instrument carrier 10 to support a heavy musical instrument, it is possible to prevent regions of the performer's body that come into contact with the musical instrument carrier 10 from becoming sore.

Referring to FIG. 1 to FIG. 4, the back rest member 19 is a band-shaped member for coupling the other end portions of the pair of shoulder rest member main bodies 61.

Both ends of the back rest member 19 are coupled to the other end portions of the pair of shoulder rest member main bodies 61 by the washer plates 26, the bolts 27, and the nut plates 28. The back rest member 19 is a member that is abutted on the back of the performer.

According to the musical instrument carrier 10 of the present embodiment, by having the shoulder rest member 18 with a constitution capable of sliding in the extension direction of the shoulder rest member 18 in the state of being brought into surface contact with the coupling member 16, it is possible to couple the coupling member 16 and the shoulder rest member 18 with a smaller bulge than the bulge formed by fastening with a screw the fastening rod holder to the conventional support rod (refer to JP-A 2003-5745).

Thereby, it is possible to improve the appearance of the musical instrument carrier 10, and possible to suppress damage to a costume in the case of a performer wearing the musical instrument carrier 10 under a costume.

In addition, since there is an increase in the resistance that occurs when the shoulder rest member 18 slides by sliding the shoulder rest member 18 in surface contact with respect to the coupling member 16, it is possible to improve the force of the coupling member 16 holding the shoulder rest member 18 (holding force). Thereby, it is possible to inhibit shifting of the musical instrument carrier 10 from the body of a performer during a performance.

Note that in the present embodiment, as one example, a description was given citing the case of providing the pair of first curved portions 41-1 and 42-1 and the second curved portion 62-1 at the portion abutted on the chest of the performer, but the arrangement position of the pair of first curved portions 41-1 and 42-1 and the second curved portion 62-1 is not limited thereto.

The pair of first curved portions 41-1 and 42-1 and the second curved portion 62-1 may for example also be arranged between the plate members 41 and 42 and the abdomen rest member 11, and may also be arranged between the plate members 41 and 42 and the shoulder rest member main bodies 61.

Moreover, the plate members 41 and 42 may be omitted, the abdomen rest member 11 and the slide member 62 may each be extended to a plate shape, and the first curved portions 41-1 and 42-1 and the second curved portion 62-1 may be respectively provided in them. It is possible to obtain the same effect as the present embodiment in such cases as well.

Also, in the present embodiment, as one example, a description was given citing the case of using the shoulder rest member 18 in which the shoulder rest member main bodies 61 and the slide member 62 are separate units, but a shoulder rest member may be used in which the shoulder rest member main bodies 61 and the slide member 62 are integrated.

The size of the pair of first curved portions 41-1 and 42-1 and the second curved portion 62-1 (for example, the magnitude of the curvature radius of the curvature d the angle forming the arc) and the extent of the curvature are not limited to the pair of first curved portions 41-1 and 42-1 and the second curved portion 62-1 shown in FIG. 4 and FIG. 5.

By changing the size of the pair of first curved portions 41-1 and 42-1 and the second curved portion 62-1 (for example, the magnitude of the curvature radius of the curvature and the angle forming the arc) and the extent of the curvature, it is possible to change the magnitude of the radius and the top-point position of the shoulder rest member 18. Thereby, application to more performers with differing body shapes becomes possible.

For example, slide members of a plurality of types with differing radius magnitudes and differing top-point positions, and coupling me b s including a pair of first curved portions corresponding the to are respectively prepared, and by using the slide members and coupling members in accordance with the physique of the performer, it is possible to apply the musical instrument carrier to more performers with differing body types.

Also, in the present embodiment as one example, a description was given taking as an example the musical instrument carrier 10 not having a hip rest member coupled to the back rest member 19 and abutting the hips of the performer, but the present invention can be applied to a musical instrument carrier having a hip rest member.

Also, in the present embodiment, a description was given taking as an example the case of the slide member 62 having three slide grooves (specifically, slide grooves 82 to 84), but in the case of forming the slide grooves in the slide member 62, the number thereof is not limited to three with one also being acceptable.

Provided there are two or more slide grooves, it is possible to slide the slide member 62 in a stable manner in the A direction shown in FIG. 5.

In the case of for example the bulging of the bolts 22-1, 22-2, and 22-3 being a concern, the head portions of the bolts 22-1, 22-2, and 22-3 may be covered with resin having a hemispherical shape.

Thereby, catching and localized rubbing of the head portions of the bolts 22-1, 22-2, and 22-3 directly on a costume are eliminated, and it is possible to inhibit to a greater degree damage to a costume.

Also, the present embodiment is constituted to hold a position by passing the shaft portions of the bolts 22-1, 22-2, and 22-3 through the slide grooves 82 to 84 and the holes and fastening them with nut plates, but a cam lever lock system may be used instead of a nut and bolt, and fastening may also be achieved by other members and constitutions.

Note that while the present embodiment is constituted to couple the abdomen rest member 11 and the slide member 62 by sandwiching them by both end sides of the pair of plate members 41 and 42, a constitution is also possible that makes the coupling member one plate member and causes the abdomen rest member 11 and the slide member 62 to each make surface contact therewith, and holds the position by a nut and bolt assembly or another fastening member.

Figure 9:
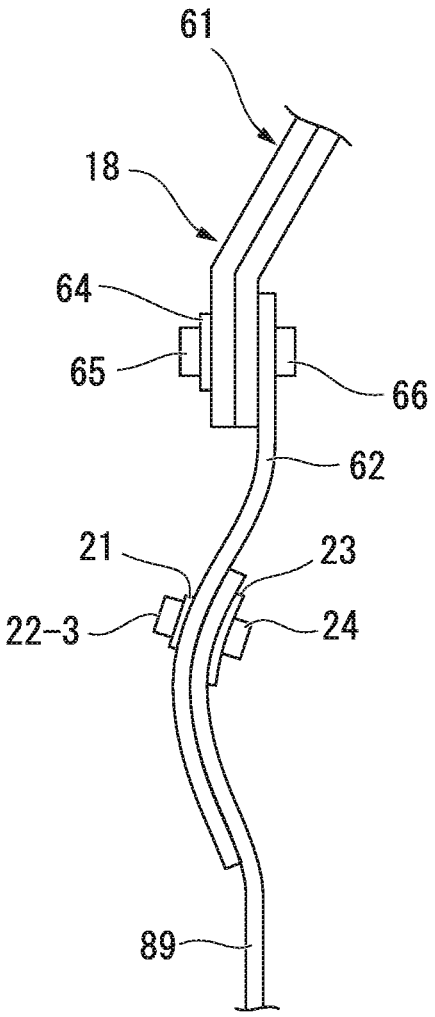
FIG. 9 is a side view showing a first modification of the musical instrument carrier of the present embodiment.

FIG. 9 is a side view showing a first modification that uses one coupling member. In FIG. 9, the same reference numerals are given to those constituent portions that are the same as the corresponding structures shown in FIG. 1 to FIG. 5. In FIG. 9, the shoulder rest member 18 shown in FIG. 5 is also illustrated.

A coupling member 89 is constituted by one plate member. At the lower end portion of the coupling member 89, the aforementioned abdomen rest member 11, not illustrated, is brought into surface contact with the opposing surface of the coupling member 89 and fastened thereto with a bolt and nut plate.

In addition, in the case of using the coupling member 89, the coupling member 89 may be arranged on the side of the performer, the slide member 62 may be arranged on the front surface side of the coupling member 89, and with the front-surface-side surface of the coupling member 89 and the back-surface-side surface of the slide member 62 brought into surface contact, they may be fasten d by the bolts 22-1, 22-2, and 22-3 and the nut plates 24.

In this way, by arranging the coupling member 89 on the performer's side and the slide member 62 on the front surface side of the coupling member 89, since it is possible to reduce the thickness of the coupling member 89 and bulging compared to the case of arranging the coupling member 89 on the front surface side of the slide member 62, when wearing the musical instrument carrier under a costume, it is possible to further inhibit damage to the costume.

Note that in the case of using the coupling member 89, the slide member 62 may be arranged on the side of the performer and the coupling member 89 may be arranged on the front surface side of the slide member 62.

Figure 10:
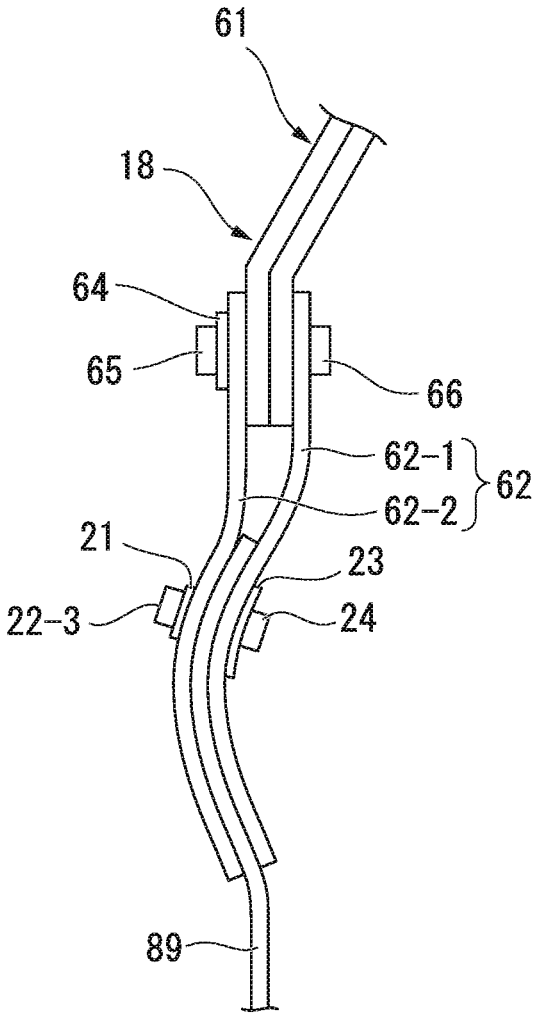
FIG. 10 is a side view showing a second modification of the musical instrument carrier of the present embodiment.

FIG. 10 is a side view that shows a second modification in which there are two slide members in the first modification shown in FIG. 9. In FIG. 10, the same reference numerals are given to those constituent members that are the same as the corresponding structures shown in FIG. 1 to FIG. 5 and FIG. 9.

The slide member 62 is constituted by aback surface side plate 62-1 and a front surface side plate 62-2. In the same manner as the first modification, at the lower end portion of the coupling member 89, the aforementioned abdomen rest member 11, not illustrated, is brought into surface contact with the opposing surface of the coupling member 89 and fastened thereto with a bolt and nut plate.

The curved portions of the back surface side slide plate 62-1 and the front surface side slide plate 62-2 are respectively brought into surface contact with the rear-surface-side curved portion and the front-surface-side curved portion of the coupling member 89 and engaged thereto. After adjusting the vertical positions of the back surface side slide plate 62-1 and the front s face side slide plate 62-2 with respect to the coupling member 89 to conform to the physique of the performer, they are fastened to the coupling member by the bolts 22-1, 22-2, and 22-3 and the nut plates 24.

In this way, by bringing both surfaces of the coupling member 89 into surface contact with the slide members 62 and engaging them thereto, it is possible to affix the abdomen rest member 11 to the shoulder rest member 18 in a more stable manner.

The embodiment described above has a constitution that allows sliding of the shaft portions of the bolts 22-1 to 22-3 along the slide grooves 82 to 83 so that continuous adjustment can be performed. However, instead of the slide grooves, a structure may be adopted in which a plurality (for example, three) holes that pass the bolts are formed along the curvature direction (the direction of the slide grooves in the embodiment) in the first curved portions 41-1 and 42-1 and the second curved portion 62-1, and by passing the bolts through the respective holes at the desired angle among the plurality, the orientation (positional relation) of the plate members 41 and 42 and the shoulder rest member 18 may be fixed.

In this case, adjustment is multistage instead of continuous, but it is possible to more favorably maintain the orientation of the plate members 41 and 42 and the shoulder rest member 18 than the constitution having slide grooves.

Figure 11:
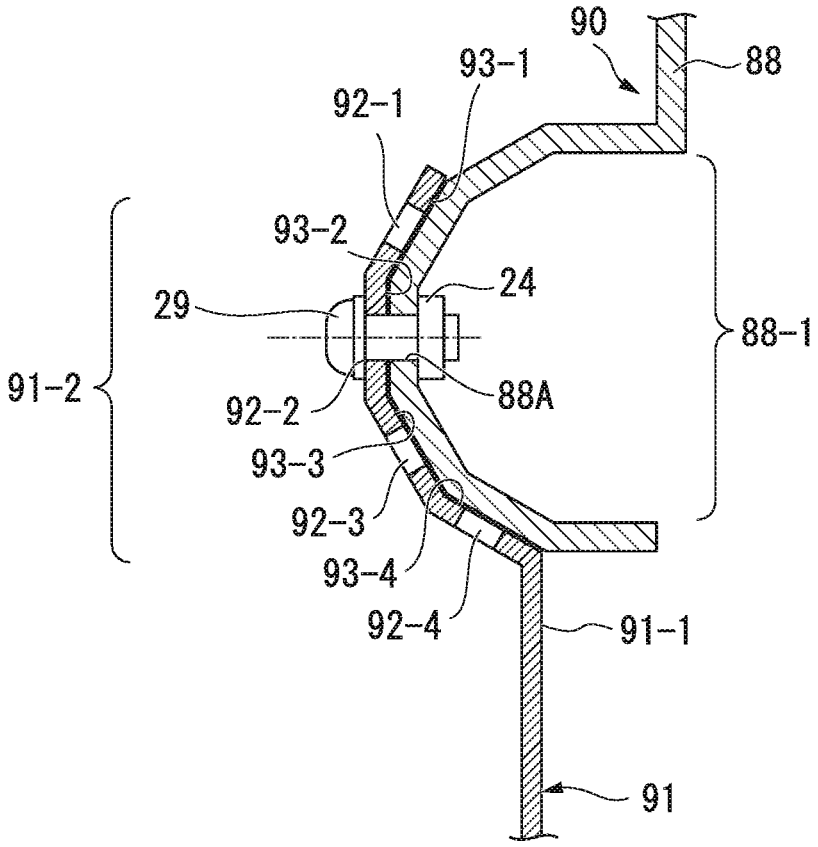
FIG. 11 is aside view showing a third modification of the musical instrument carrier of the present embodiment.

FIG. 11 is a side view that shows the main portions of a third modification, which, as a constitution capable of adjustment in four stages, is a constitution that eliminates the pair of plate members and directly couples the abdomen rest member and the shoulder rest member. In FIG. 11, the same reference numerals are given to those constituent portions that are the same as the corresponding structures shown in FIG. 5.

The abdomen rest member 91 has the same constitution as the aforedescribed abdomen rest member 11, with an extension portion 91-1 having the same shape as the plate member 41 being extended from the center thereof. A bent portion 91-2 is formed at the extension portion 91-1.

The bent portion 91-2 is formed by four flat surfaces 93-1, 93-2, 93-3, and 93-4 joined at an angle to one another at the portion facing a shoulder rest connection member 88. Holes 92-1, 92-2, 92-3, and 92-4 penetrated by three bolts 29 (bolts having the same constitution as the aforementioned bolts 22-1 to 22-3) that are arranged in the depth direction in the drawing are formed in the four surfaces constituting the bent portion 91-2. A curved surface is formed in the side of the bent portion 91-2 not facing the shoulder rest connection member 88.

The shoulder rest member 90 is the same structure as the slide member 62 mentioned above except for one portion, and has the shoulder rest connection member 88 that is a plate-like member formed in a U shape, a coupling bolt hole 88A, and a bolt hole (not illustrated).

At both end portions of the shoulder rest connection member 88, a shoulder rest member 61 that is not illustrated is connected by the bolts 65 and nuts 66 to bolt holes (not illustrated) in the same manner as the slide member 62 described above.

A bent portion 88-1 that faces the bent portion 91-2 of the abdomen rest member 91 is formed at the central portion of the shoulder rest connection member 88. The bent portion 88-1 is formed by seven flat surfaces joined at an angle to one another. A coupling bolt hole 88A is provided in one surface formed in the bent portion 88-1. By screwing the coupling bolt 29 into the nut 24 in the state of penetrating the coupling bolt hole 88A and any one of the holes 92-1, 92-2, 92-3, and 92-4 in the state of the bent portion 91-2 of the abdomen rest member 91 facing thereto, the abdomen rest member 91 and the shoulder rest member 90 are coupled.

In the abdomen rest member 91 and the shoulder rest member 90 constituted in this manner, any of the four flat surfaces 93-1, 93-2, 93-3, and 93-4 forming the bent portion 91-2 is selectively matched with the surface having the coupling bolt 29 and fastened with the coupling bolt 29 and the nut 24 in that matched state, whereby it is possible to stably adopt any of the four orientations in which the angular relationship between the abdomen rest member 91 and the shoulder rest member 90 differ.

Accordingly, in the case of applying such a constitution, in the state of the shoulder rest member 90 being brought into surface contact with the abdomen rest member 91 and in a multistage manner, it is possible to adopt any of the four orientations in which the angular relationship between the abdomen rest member 91 and the shoulder rest member 90 differ.

In the case of such a constitution, it is possible to obtain the same effect as the musical instrument carrier 10 described previously.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A musical instrument carrier that supports a musical instrument in front of a performer, the musical instrument carrier comprising:

a shoulder rest member that is abutted on the shoulders of the performer;

an abdomen rest member that is provided separately from the shoulder rest member, that is directly or indirectly coupled to the shoulder rest member, and that is abutted on the abdomen of the performer; and a plurality of plate-like members that each have a curved portion or a bent portion, wherein the shoulder rest member and the abdomen rest member are coupled by overlapping and affixing the plurality of plate-like members in a state of making surface contact, an angle of the abdomen rest member with respect to the shoulder rest member being changed by mutually changing an overlapping position of the curved portions or the bent portions in the plurality of plate-like members.

2. The musical instrument carrier according to claim 1, wherein the plurality of plate-like members include a coupling member that is included in the abdomen rest member and a slide member that is included in the shoulder rest member;

the slide member is located at the abdomen rest member side of the shoulder rest member and arranged on at least one surface of the coupling member; and the shoulder rest member and the abdomen rest member are coupled by being fastened with a fastening means in a state where a surface of the curved portion or the bent portion provided in the slide member and a surface of the curved portion or the bent portion provided in the coupling member are overlapped.

3. The musical instrument carrier according to claim 1, wherein the plurality of plate-like members include a coupling member that is included in the abdomen rest member and a slide member that is included in the shoulder rest member;

the coupling member is located at the shoulder rest member side of the abdomen rest member and arranged on at least one surface of the slide member; and the shoulder rest member and the abdomen rest member are coupled by being fastened with a fastening means in a state where a surface of the curved portion or the bent portion provided in the coupling member and a surface of the curved portion or the bent portion provided in the slide member are overlapped.

4. The musical instrument carrier according to claim 3, wherein the slide member is constituted to be slidable with respect to the coupling member in a circular arc shape or in multiple stages.

5. The musical instrument carrier according to claim 3, wherein the slide member is detachable at different positions in multiple stages with respect to the coupling member.

6. A musical instrument carrier that supports a musical instrument in front of a performer, the musical instrument carrier comprising:

a shoulder rest member that is abutted on the shoulders of the performer;

an abdomen rest member that is provided separately from the shoulder rest member, that is directly or indirectly coupled to the shoulder rest member, and that is abutted on the abdomen of the performer; and a plurality of plate-like members that each have a curved portion or a bent portion, wherein the shoulder rest member and the abdomen rest member are coupled by overlapping and affixing the plurality of plate-like members in a state of making surface contact, the plurality of plate-like members include two plates that are oppositely arranged with a predetermined spacing and one plate, the one plate provided in the shoulder rest member is arranged between the two plates, and both surfaces of the one plate respectively make surface contact with the opposing surfaces of the two plates.

7. A musical instrument carrier that supports a musical instrument in front of a performer, the musical instrument carrier comprising:

a shoulder rest member that is abutted on the shoulders of the performer;

an abdomen rest member that is provided separately from the shoulder rest member, that is directly or indirectly coupled to the shoulder rest member, and that is abutted on the abdomen of the performer; and a plurality of plate-like members that each have a curved portion or a bent portion, wherein the shoulder rest member and the abdomen rest member are coupled by overlapping and affixing the plurality of plate-like members in a state of making surface contact, the plurality of plate-like members include two plates that are oppositely arranged with a predetermined spacing and one plate, the one plate provided in the abdomen rest member is arranged between the two plates, and both surfaces of the one plate respectively make surface contact with the opposing surfaces of the two plates.

* * * * *